United States Patent [19]

Bracey et al.

[11] 4,221,140

[45] Sep. 9, 1980

[54] FILTER WRENCH

[76] Inventors: Bobby R. Bracey, c/o George Spector, 3615 Woolworth Bldg., 233 Broadway; George Spector, 3615 Woolworth Bldg., 233 Broadway, both of New York, N.Y. 10007

[21] Appl. No.: 918,150

[22] Filed: Jun. 22, 1978

[51] Int. Cl.[2] ..... B25B 13/52

[52] U.S. Cl. ..... 81/64

[58] Field of Search ..... 81/64, 3.43, 121 R; 24/20 TT; 85/9 R

[56] References Cited

U.S. PATENT DOCUMENTS

| | | | |
|---|---|---|---|
| 1,371,933 | 3/1921 | Rebman | 81/121 R |
| 2,995,965 | 8/1961 | Hockney | 81/64 |
| 3,728,916 | 4/1973 | Brantley | 81/64 |
| 4,037,495 | 7/1977 | Beckstead | 81/64 |

*Primary Examiner*—James L. Jones, Jr.

[57] ABSTRACT

A wrench for firmly grasping a vehicle oil filter during installation or removal thereof; the wrench including a bolt or rod which one end has a hexagonal head for being grasped by a conventional wrench, the bolt having a long slot through which an endless fabric strap is fitted, and which in use fits around the filter, so that when the bolt is then rotated, it winds up the strap tightly around the filter and firmly grasps it, in order that the filter can then be rotated and screwed or unscrewed from the vehicle engine; the device in a modified construction having the bolt slot extending from the hexagonal head end so to be stronger.

3 Claims, 4 Drawing Figures

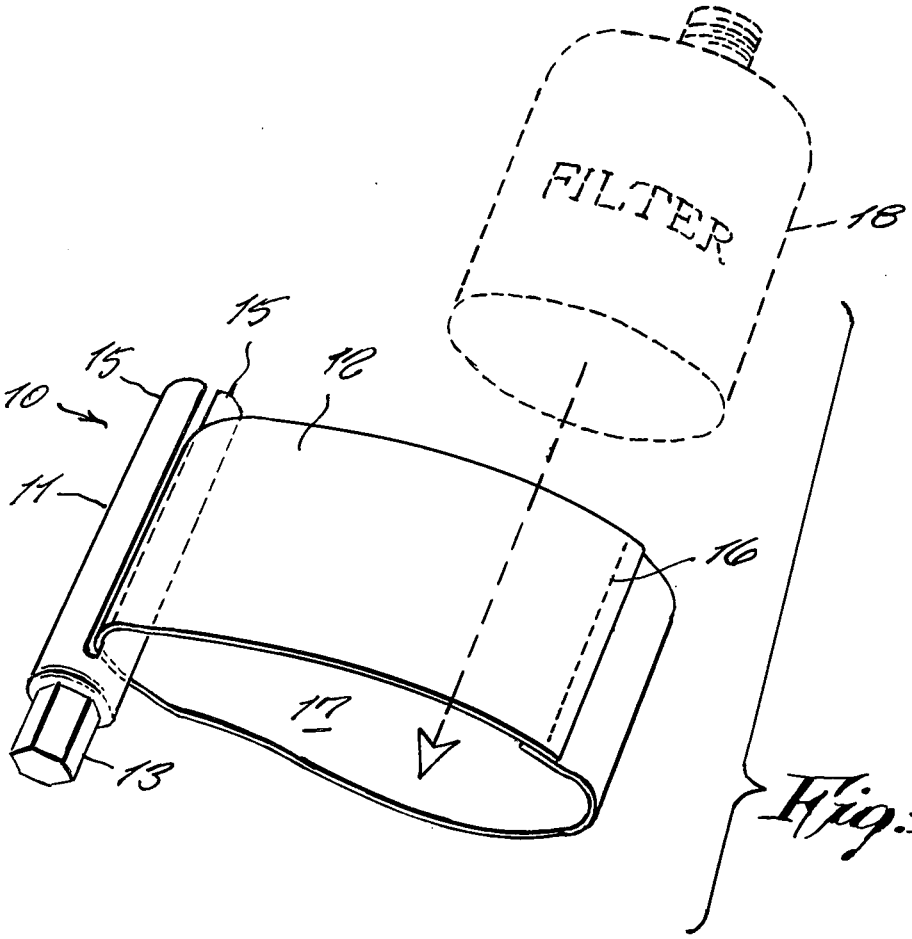
Fig. 1
Fig. 2
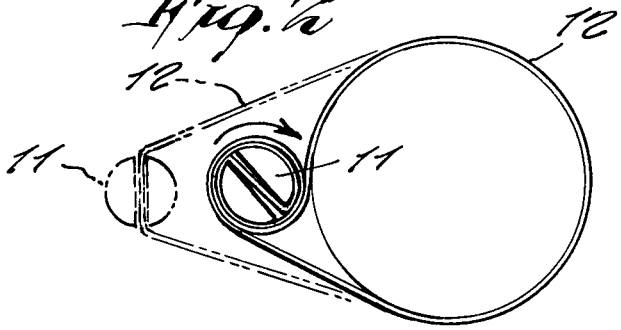
Fig. 3
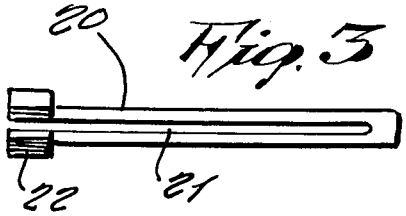
Fig. 4
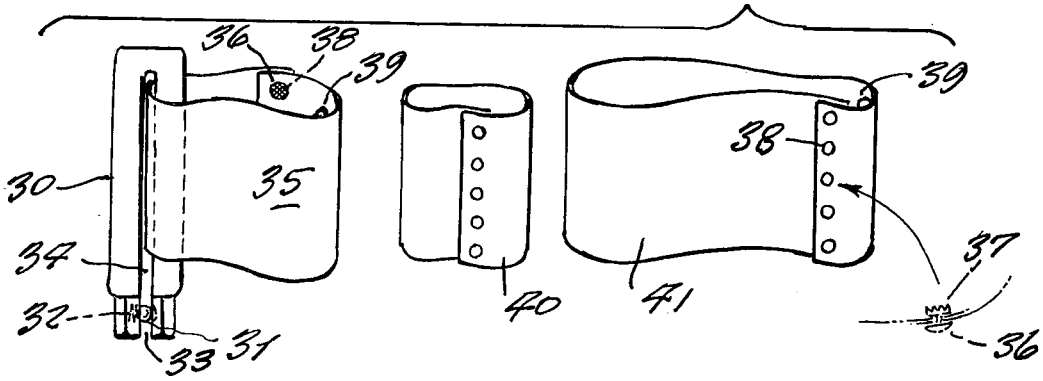

FILTER WRENCH

This invention relates generally to automotive vehicle serving tools.

It is generally well known that many motorists now-a-day service their own vehicles, and usually have difficulty in removing an oil filter from the engine, as the screw threads may become rusted together or else after a long time just simply get hard stuck together. This situation is therefore in want of an improvement.

Accordingly, it is a principal object of the present invention to provide an oil filter wrench, for use by motorists or service station mechanics, and which firmly grasps the filter for easily loosening or tightening the filter or an engine of an automobile, truck, or other vehicle.

Another object is to provide an oil filter wrench which can be used together with any conventional wrench such as a ratchet wrench, open end wrench or the like, and which can be twisted either to right or left so to screw or unscrew.

Yet a further object is to provide an oil filter wrench which consists of only two parts so to not be complicated for any user.

Other objects are to provide a filter wrench which is simple in design, inexpensive to manufacture, rugged in construction, easy to use and efficient in operation.

These and other objects will be readily evident upon a study of the following specifications and the accompanying drawing wherein:

FIG. 1 is a perspective view of the invention.

FIG. 2 is an end view thereof shown being rolled up around an auto filter.

FIG. 3 is a side view of a modified design of the invention in which the slit opens out through a hex head of the wrench, so to be stronger in use because the hex head is held inside a socket wrench while in use thus preventing the forked legs to spread apart.

FIG. 4 illustrates a further modified design in which the wrench is made in a kit with different sizes of belts so to be used for grasping any other object other than a filter.

Refering now to the drawing in greater detail, and more particularly to FIGS. 1 and 2 thereof at the present time, the reference numeral 10 represents a filter wrench according to the present wherein there is a rod or bolt 11 and an endless fabric strap 12 supported on the bolt.

The bolt comprises an elongated, cylindrical member which at one end has a hexagonal head 13 so to be engaged by any conventional wrench. The opposite end of the bolt has an longitudinal slot 14 that opens out on the bolt end 15 and which extends almost to the bolt head.

The strap is made of a length of nylon or strong canvas fabric in which the opposite ends of the fabric are stitched together by a nylon cord 16 so to form the endless strap construction. The strap fabric may be approximately 3½ inches wide and the length of the closed loop around central opening 17 may be approximately 8 inches long so that the opening is sufficiently large enough for receiving an oil filter 18 therein.

The length of the bolt slot is sufficiently long so that the full width of the strap fits therein.

In operative use, the strap is fitted around the oil filter and the bolt is then rotated so to wind up a surplus portion of the strap therearound. Thus the filter is firmly grasped all around so to prevent slipping inside the strap opening 17, as shown by solid lines in FIG. 2. The strap can be wound up either toward a left or toward a right, so to hold the filter when screwing the filter thread 19 either on or off the vehicle engine.

In FIG. 3, a modified design of the invention includes bolt 20 having slot 21 extend from the bolt end that includes the bolt hexagonal head 22. Thus in this design when the bolt head is grasped by a conventional bolt, the bifurkated ends of the bolt are held together by the wrench and prevented from spreading apart in case a great tightening force is affixed by the strap around the filter.

In FIG. 4, a further modified design of the invention includes a bolt 30 which is bifurkated at the bolt head end similarly to bolt 20 and which additionally includes a detent ball 31 urged by detent spring 32 to close the entrance 33 to the slot 34 thus preventing the strap from dropping out of the slot. In this design, the strap 35 is not permanently stitched into a loop but is held looped by a plurality of removable screws 36 held by nuts 37 so that the strap is adjustable by filling the screws through either rows of strap holes 38 and 39.

In this design, the filter wrench is retailed as a kit having one bolt and several different interchangable additional straps 40 and 41 of different sizes, different textured inner surfaces so to be suitable to grasp different types of objects and also being of various widths, each strap being held by like above-described screws 36 and nuts 37. Thus the tool can be used for other applications than only around oil filters.

While various changes may be made in the detail construction, it is understood that such changes will be within the spirit and scope of the present invention as in defined by the appended claims.

What is claimed is:

1. A strap wrench adapted to rotate containes, comprising in combination, a tool having a polygonal head at one end for being grasped by a conventional wrench in order to be rotated, said tool having a longitudinally extending slot providing opposing edges at both sides of said slot in combination with an endless strap of flexible material fitted through said slot closely adjacent said edges, whereby rotation of said bolt causes said edges to grasp said strap along transversely spaced areas thereabout a container and whereby said slot extends through said head.

2. The combination as set forth in claim 1, wherein said strap includes means for varying its length.

3. The combination of claim 1, wherein said head includes resilient means for blocking the slot therethrough to prevent displacement of said strap through said head.

* * * * *